US006020905A

United States Patent [19]

Cornell et al.

[11] Patent Number: 6,020,905

[45] Date of Patent: Feb. 1, 2000

[54] INK JET PRINTHEAD FOR DROP SIZE MODULATION

[75] Inventors: Robert Wilson Cornell; Steven Robert Komplin; Jack William Morris; James Harold Powers; Lawrence Russell Steward, all of Lexington, Ky.

[73] Assignee: Lexmark International, Inc., Lexington, Ky.

[21] Appl. No.: 08/788,538

[22] Filed: Jan. 24, 1997

[51] Int. Cl.[7] ..... B41J 2/05

[52] U.S. Cl. ..... 347/48; 347/15; 347/62

[58] Field of Search ..... 347/48, 62, 58, 347/15

[56] References Cited

U.S. PATENT DOCUMENTS

| | | | |
|---|---|---|---|
| 4,251,824 | 2/1981 | Hara | 347/48 X |
| 4,281,333 | 7/1981 | Tsuzuki et al. . | |
| 4,499,479 | 2/1985 | Chee-Shuen Lee et al. | 347/15 |
| 4,513,299 | 4/1985 | Lee et al. . | |
| 4,680,645 | 7/1987 | Dispoto et al. . | |
| 4,730,197 | 3/1988 | Raman et al. . | |
| 4,809,021 | 2/1989 | Check et al. . | |
| 4,965,594 | 10/1990 | Komuro | 346/62 |
| 5,124,716 | 6/1992 | Roy et al. . | |
| 5,172,139 | 12/1992 | Sekiya | 347/62 X |
| 5,198,833 | 3/1993 | Kubota . | |
| 5,202,659 | 4/1993 | DeBonte et al. . | |
| 5,221,931 | 6/1993 | Moriyama . | |
| 5,223,853 | 6/1993 | Wysocki et al. . | |
| 5,412,410 | 5/1995 | Rezanka . | |
| 5,461,403 | 10/1995 | Wallace et al. . | |
| 5,481,287 | 1/1996 | Tachihara | 347/62 |
| 5,495,270 | 2/1996 | Burr et al. . | |
| 5,731,828 | 3/1998 | Ishinaga | 347/62 |

FOREIGN PATENT DOCUMENTS

| | | | |
|---|---|---|---|
| 61-118259 | 6/1986 | Japan | B41J 3/04 |
| 62-35852 | 2/1987 | Japan | B41J 3/04 |
| 62-261453 | 11/1987 | Japan | B41J 3/04 |
| 1-237151 | 9/1989 | Japan | B41J 3/04 |
| 5-208496 | 8/1993 | Japan | B41J 2/05 |
| 6-134989 | 5/1994 | Japan | B41J 2/05 |

*Primary Examiner*—Joseph Hartary
*Attorney, Agent, or Firm*—John J. McArdle

[57] ABSTRACT

Disclosed is an ink jet printhead apparatus for modulating drop size. Drop size modulation is achieved by providing an ink jet printhead chip for use in an ink jet printhead having a cavity in communication with a supply of ink and a nozzle. The chip includes an actuator having a first active section and a second active section. The first and second active sections are positioned at a substantially equal distance from the nozzle.

2 Claims, 8 Drawing Sheets

INK JET PRINTHEAD FOR DROP SIZE MODULATION

FIELD OF THE INVENTION

The present invention relates to ink jet printing apparatuses and more particularly, to ink jet printhead apparatuses for drop size modulation wherein ink drop size is selectively varied.

BACKGROUND OF THE INVENTION

Standard thermal ink jet printheads, operated in a conventional manner, eject an essentially fixed ink mass from each nozzle.

Drop mass modulation, the process where ejected ink mass is varied on demand, can substantially enhance the quality of printed output. Ink jet and other non-impact printers have long been contemplated as particularly well suited to the production of continuous and half tone images because of the ability to produce a spot at any location on a sheet of paper. However, the ability of ink jet printers to produce continuous and half tone images has been quite limited due to the fact that most ink jet printheads can only produce droplets having fixed volume. As a result, ink spots produced by such droplets are of a fixed size. Furthermore, ink jet printheads typically use a fixed resolution, typically 300–400 dots per inch or lower, to place droplets on a sheet of paper. This is not sufficient to produce half-tone images which require higher print quality.

The quality of printed output can also be enhanced by increased print resolution where the number of droplets per square inch is increased, for example, from 300×300 dots per inch matrix to 600×600 dots per inch matrix. Drop mass modulation is often preferred over increased print resolution. This is because drop size modulation does not significantly increase print head complexity and because it requires a smaller increase in data handling capability than does a comparable increase in print resolution. This difference in data handling capability is often unappreciated and, therefore, a brief theoretical discussion is provided below highlighting the theoretical advantages of drop size modulation over increased print resolution.

In their simplest form, digital print mechanisms operate by filling a pattern of dot positions on a square grid on the printed page. Information is represented by devoting a single byte to each dot position in an R×R grid. The symbol R denotes print resolution, which is traditionally described by the number of dots per inch on one side of the grid. Each byte is comprised of an integral number of bits. Each bit b conveys one of two possible states; hence the term binary state:

$$b=0 \text{ or } 1.$$

Each byte $B_k$ is comprised of k bits, where k can be any positive integer:

$$B_k=(b_1, b_2, \ldots, b_k).$$

A byte $B_k$ has two relevant properties: the number $N_k$ of bits of which it is comprised:

$$N_k=N(B_k)=k,$$

and the number $S_k$ of possible states conveyed:

$$S_k=S(B_k)=2^k.$$

Hence, a byte $B_1$ contains a single bit and conveys two states; a byte $B_2$ contains two bits and conveys four states; and a byte $B_3$ contains three bits and conveys eight states, and so forth for larger values of k where:

$$B_1=(0) \text{ or } (1),$$

$$B_2=(0,0) \text{ or } (0,1) \text{ or } (1,0) \text{ or } (1,1),$$

$$B_3=(0,0,0) \text{ or } (0,0,1) \text{ or } (0,1,0) \text{ or } (0,1,1) \text{ or } (1,0,0) \text{ or } (1,0,1) \text{ or } (1,1,0) \text{ or } (1,1,1).$$

Standard monochrome printing (with no dot size modulation) requires one $B_1$-sized byte for every dot in the print grid. Hence, a volume $V_0$ of data is required to print a unit grid, where:

$$V_0=N_1\times R^2=R^2$$

If print resolution R is increased by a factor F, then the required data volume per unit print grid becomes $$V_1=N_1\times(FR)^2,=F^2R^2,=F^2V_0$$

Hence, the data volume increases by a multiplicative factor $F^2$ when print resolution increases by a factor F.

Suppose that, as an alternative to increasing print resolution, the number of printable dot states M increases from two (dot or void) to some larger integer number. The additional information is represented by increasing the size of the byte associated with each position of the print grid. The smallest byte that conveys M dot states is one with k bits, where k is the smallest positive integer that satisfies the inequality $$M\leqq S_k=2^k.$$

Hence, while the possible states of a simple dot with no size modulation can be conveyed with a byte $B_1$ (with two states), the state of a dot with two or three possible sizes can be conveyed with a byte $B_2$ (with four states). The data volume requirement for dot size modulation can be compared to that of standard monochrome printing. The data volume $V_2$ per unit grid, required to print dots with M possible states, is given by $$V_2=N_k\times R^2,=kR^2,=kV_0,$$

where k is the smallest positive integer that satisfies the above inequality.

Hence, data volume increases by a multiplicative factor k as the number of dot states increases from two to M at fixed print resolution. It is instructive to express the data volume $V_2$ directly in terms of the parameter M. Recall that the number of bits k is the smallest positive integer that satisfies the inequality $M\leqq 2^k$. If we take the natural logarithm of both sides of the inequality, we obtain $$\log M\leqq k \log 2.$$

Therefore, we can make a substitution in the formula for $V_2$:

$$V_2=kV_0\geqq(\log M/\log 2)V_0$$

Hence, it can be said that the data volume $V_2$, characterizing the addition of dot states M, increases roughly as the natural logarithm of M. Thus, in terms of increasing print quality, dot size modulation is preferred to increasing print resolution, since the logarithm function grows dramatically slower than the square function that characterizes the relationship between data volume and print resolution.

Even considering the major theoretical advantages of drop size modulation, no workable system has yet been developed, although various strategies have been attempted to modulate the size of an ink drop being ejected. Many patents have focused on adjusting the amplitude of the voltage pulse and/or the timing of each of the voltage pulses. See, for example, Tsuzuki et al. U.S. Pat. No. 4,281,333; Lee et al. U.S. Pat. No. 4,513,299; DeBonte et al. U.S. Pat. No. 5,202,659. These patents suffer from the disadvantage that each requires a complex control circuit and large data handling capability.

Chip temperature control schemes have also been attempted with limited success, see Wysocki et al. U.S. Pat. No. 5,223,853. Other methods focus on fluid dynamics of the meniscus of the ejected droplet, see Burr et al. U.S. Pat. No. 5,495,270.

A different approach, using simplified control circuits is disclosed in U.S. Pat. No. 4,499,479. The '479 patent discloses an ink jet drop-on-demand printing system comprising a transducer having a plurality of separately actuable sections. This patent is directed to a side-shooter type printhead. Print data is provided which defines a selected drop volume and control means is provided which is operable in response to print data to produce signals to selectively actuate a particular combination of the separately actuable sections of the transducer to produce a drop of a volume specified by the print data. To provide further control over the drop volume, in a second embodiment, while maintaining the drop of velocity within selected limits, the amplitude of the drive signals can also be varied. In a first embodiment, the piezoelectric transducer sections are of an equal length, whereas in the second embodiment the transducer sections are of unequal length. Disadvantageously, this patented design requires a relatively complicated structure for exciting the ink in ink cavity. Furthermore, it is difficult to predict the variation of drop volume with amplitude and pulse width at constant drop velocity as described in that patent. The '479 patent recognized that generating a drop size look-up table would be difficult because of the large number of interrelated factors which affect the printhead operation. The large number of factors include the different distances that each of the separately actuable sections are disposed from the nozzle as well as the interrelationship between each of the separately actuable sections. See U.S. Pat. No. 4,730,197 which describes and characterizes numerous interactions between ink jet geometric features, drive waveforms, meniscus resonance, pressure chamber resonance, and ink jet ejection characteristics.

Accordingly, a need still exists in the art for a printhead capable of drop size modulation having simplified geometric features, using simplified control circuits and which reduces the data handling requirement of the digital print controller.

SUMMARY OF THE INVENTION

It is, therefore, an object of this invention to overcome to a large extent the above-mentioned problems and to satisfy the above-mentioned needs.

Another object of the present invention is to modulate the ejected drop mass using a printhead having simplified geometric features.

These and other objects of the present invention are achieved by providing an ink jet printhead chip for use in an ink jet printhead having a cavity in communication with a supply of ink and a nozzle. An actuator has a first active section and a second active section. The first and second active sections are advantageously positioned substantially the same distance from the nozzle to simplify the geometric features of the printhead and the interrelationships between the two active sections.

A further object is to further provide a third active section of the actuator. Yet another object is to couple the printhead chip to means for selectively applying a separate driving pulse at a first voltage to a first conductor to activate the first section of the actuator and for selectively applying a separate driving pulse at a second voltage to a second conductor to activate a second section of the actuator.

These and other objects of the present invention are achieved by providing an ink jet printhead having an ink jet printhead chip for use in an ink jet printhead having a cavity in communication with a supply of ink and a nozzle. An actuator has a first active section and a second active section. The first and second active sections are advantageously positioned substantially the same distance from the nozzle to simplify the geometric features of the printhead and the interrelationships between the active sections.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modification in various obvious respects, all without departing from the invention. Accordingly, the drawing and description are to be regarded as illustrative in nature, and not as restrictive.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein.

DETAILED DESCRIPTION OF THE INVENTION

Figure 1:
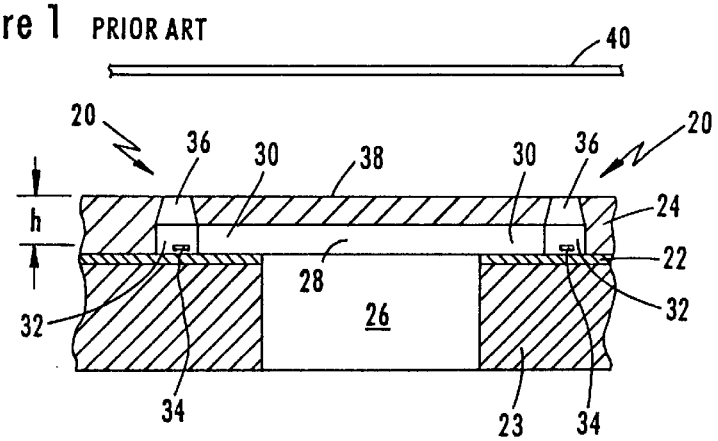
Figure 1 PRIOR ART
FIG. 1 is a side sectional elevational view of a typical prior art top shooter ink jet printhead.

Referring first to FIG. 1, a typical drop-on-demand ejector of an ink jet printhead is depicted. This type of printhead is typical of those used with the heater structures discussed below with respect to embodiments 1–5. The brief description provided below of the drop-on-demand printhead reflects the operating environment of the present invention and is not meant to be a full description of each of the elements which are well known to those of ordinary skill in this art.

Referring now to FIG. 1, a plurality of drop ejecting elements 20 are typically aligned in a linear array in parallel rows. Drop ejecting elements 20 are formed on a barrier plate 22 mounted on a chip 23 and are centered below a nozzle plate 24. For convenience, the invention will be described in relation to the orientation depicted in FIG. 1, and consequently, terms such as "above," "below," and "left," as used herein are to be construed in the relative sense. Formed within barrier plate 22 and chip 23 is an open via 26. Nozzle plate 24 includes an ink supply region 28 disposed above open via 26. Extending from opposite sides of ink supply region 28 are a pair of ink feed channels 30 each in communication with a respective firing chamber 32. Mounted within each firing chamber 32 is a respective firing element 34 which is the subject of the present invention. Formed within nozzle plate 24 and extending upwardly from firing chamber 32 is a nozzle 36. Ink is supplied from open via 26 through ink supply regions 28 into firing chambers 32. Actuation of firing element 34 causes ink to be ejected through a respective nozzle 36. Firing elements 34 are positioned a fixed distance h from a top surface 38 of nozzle plate 24 as depicted in FIG. 1 such that the entire top surface of firing element 34 is the same vertical distance from the outlet of nozzle 36.

Ink from the open via is retained within each ink feed channel 30 until, in response to a driving pulse from a control means, it is rapidly heated and vaporized by the firing element 34 disposed within the firing chamber 32. This rapid vaporization of the ink creates a bubble which causes a quantity of ink to be ejected through nozzle 36 to a copy sheet 40. The droplet strikes the paper's specified location related to the image being produced and forms an ink spot having a diameter directly related to the volume of the ejected droplet.

With reference to FIGS. 2–6, a heater structure is illustrated which is constructed in accordance with the principles of the present invention. With regards to FIGS. 1–3 only the operative thin film layers are described. The layers not described are presumed to be similar to those found in standard thermal ink jet applications and should be readily known to those of ordinary skill in the art.

It should also be understood that although the invention is described using heater elements (actuators) for ink drop formation, it is also possible to use other methods of ink drop formation in practicing the present invention, such as for example, electro-magnet-solenoid actuators and piezoelectric actuators.

Figure 2:
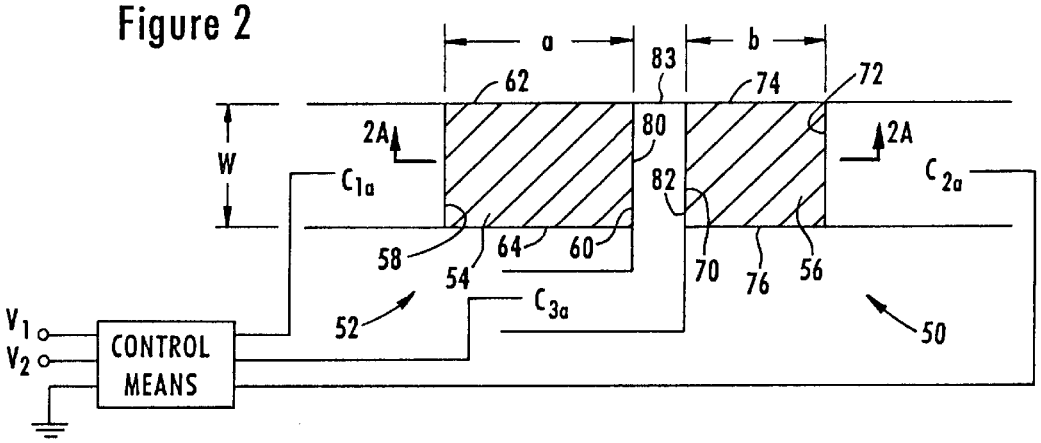
FIG. 2 is a top plan view of a first embodiment of the printhead heater structure of the present invention.
Figure 2A:
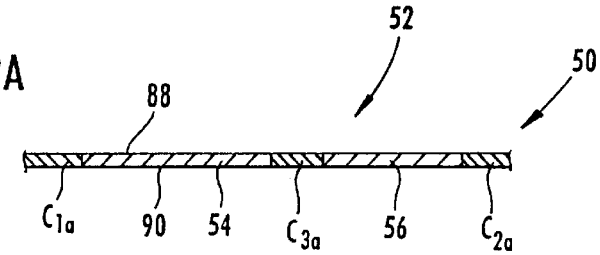
FIG. 2A is a side sectional elevational view taken along line 2A—2A of FIG. 2 depicting only the resistive element and associated conductors.

Refer now to FIGS. 2 and 2A, where a printhead heater structure according to a first embodiment of the present invention is depicted. Firing element 50 is preferably formed of a resistive heater element typically used in ink jet printer applications. Firing element 50 includes a resistive element 52 which is divided into a first active section 54 and a second active section 56, each of which has a rectangular shape. First active section 54 has a left edge 58 and a right edge 60, a top edge 62 and a bottom edge 64. Left edge 58 abuts a conductor $C_{1a}$ both of which have a width w. Top edge 62 and bottom edge 64 each have a length a.

Second active section 56 has a left edge 70, a right edge 72, a top edge 74, and a bottom edge 76. Right edge 72 is adjacent to a second conductor $C_{2a}$, both of which have a width w. Top edge 74 and bottom edge 76 each have a length b. A third conductor $C_{3a}$ is disposed between first active section 54 and second active section 56. Conductor $C_{3a}$ has a left edge 80 adjacent to and in contact with right edge 60 of first active section 54 and a right edge 82 adjacent to and in contact with left edge 70 of second active section 56. Conductor $C_{3a}$ has a top edge 83 aligned with top edges 62 and 74. The electrical resistance of elements 54 and 56 can be varied by varying the widths of conductors $C_{1a}$ and $C_{2a}$. Conductor $C_{3a}$, as depicted in FIG. 2, extends outwardly from resistive element 52.

Conductors $C_{1a}$, $C_{2a}$ and $C_{3a}$ are electrically connected to a control means. The control means is electrically connected to a first constant voltage source $V_1$, a second constant voltage source $V_2$ and a common, such as a ground. In operation the control means acts as a switch for coupling conductor $C_{1a}$ to $V_1$, conductor $C_{2a}$ to $V_2$ and conductor $C_{3a}$ to the common to activate active sections 54 and 56. Alternatively, conductor $C_{3a}$ can be connected directly to the common.

Refer now to FIG. 2A. Heater structure 50 has a flat upper surface 88 and a flat lower surface 90 formed from conductors $C_{1a}$, $C_{2a}$, $C_{3a}$ and first active section 54 and second active section 56, respectively. In the embodiment of FIG. 2A, all three conductors are formed in the same optical mask step so they lie in the same thin film layer. In operation, if the two heater sections 54 and 56 are of lengths a and b, then the ratio of lengths determines the ratios of ejected ink mass obtained by activating the two sections either individually or in combination. If, for example, the heater lengths are chosen such that a=2b then firing element 50 becomes a tri-modal drop ejector, with ejected ink mass varying in the approximate proportions 1:2:3. Ejection of the smallest drop is achieved by activating the section between conductors $C_{2a}$ and $C_{3a}$ An intermediate sized drop is ejected by activating the section 54 between conductors $C_{1a}$ and $C_{3a}$, and the largest drop is ejected by activating both sections 54 and 56 simultaneously. In this embodiment, as in all the embodiments described in this patent, means are provided for selectively applying a separate driving pulse at a first voltage through a first conductor and for applying a separate driving pulse at a second voltage through a second conductor. In this first embodiment, applying a voltage to conductor $C_{2a}$ actives section 56. As is known to those of ordinary skill in this art, the timing and duration of the pulses can be varied to achieve different drop sizes.

Figure 2B:
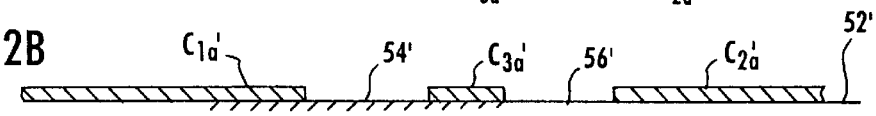
FIG. 2B is an alternative to the side sectional view of FIG. 2A.

The overall structure of FIG. 2 may also be implemented as shown in FIG. 2B. Components shown in FIG. 2B which perform functions similar to that of components shown in FIG. 2A will share common numerical designations. As shown in FIG. 2B, a resistive element 52' forms a substrate layer onto which conductors $C_{1a}'$, $C_{2a}'$ and $C_{3a}'$ are attached. With this arrangement, a first active region 54' of resistive element 52' is defined substantially between conductors $C_{1a}'$ and $C_{3a}'$, and a second active region 56' of resistive element 52' is defined substantially between conductors $C_{2a}'$ and $C_{3a}'$.

The embodiments of FIGS. 2, 2A, and 2B can be implemented into either a top shooter or a side shooter type ink jet printhead. When implemented in a top shooter type ink jet printhead, either a single nozzle is aligned over the combined heater or otherwise two nozzles, one above each heater section is used.

Figure 3:
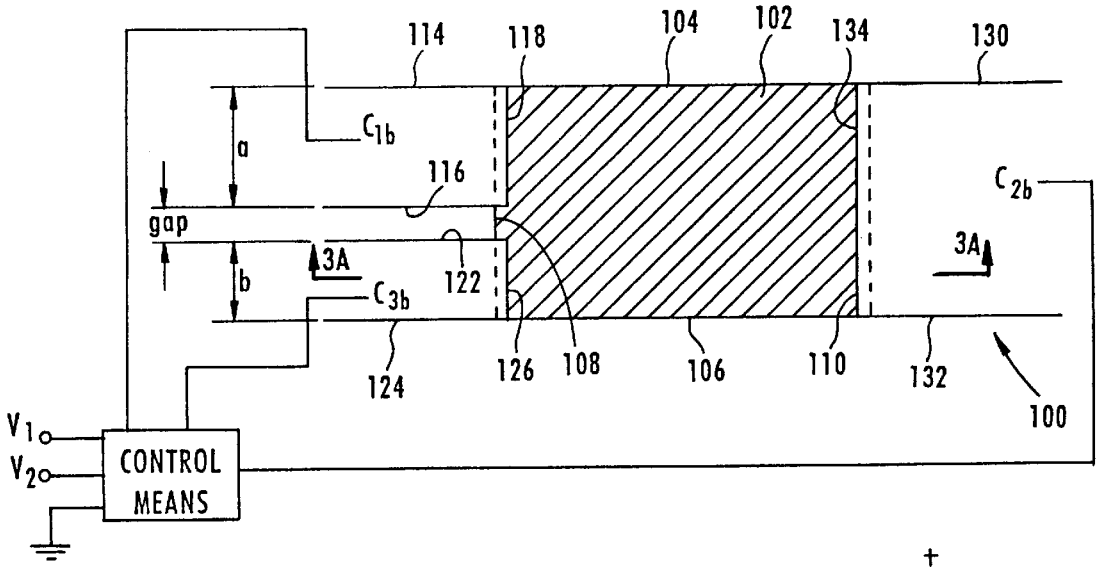
FIG. 3 is a top plan view of a second embodiment of the printhead heater structure of the present invention.
Figure 3A:
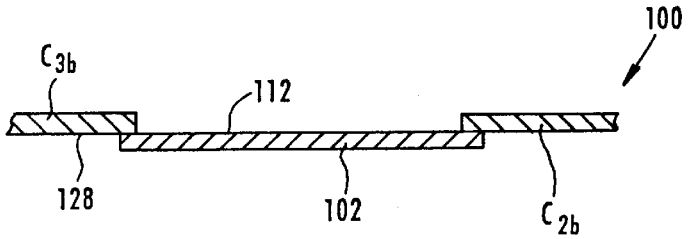
FIG. 3A is a side sectional elevational view taken along line 3A—3A of FIG. 3 depicting only the resistive element and associated conductors.

Refer now to FIGS. 3 and 3A where a printhead heater structure according to a second embodiment of the present invention is depicted. A firing element 100 includes a flat rectangular resistive element 102, a first conductor $C_{1b}$ connected to a control means, a second conductor $C_{2b}$ connected to the control means, and a third conductor $C_{3b}$ connected to the control means. The control means is electrically connected to a first constant voltage source $V_1$ a second constant voltage source $V_2$ and a common, such as a ground. The control means acts as a switch for coupling conductor $C_{1b}$ to $V_1$, conductor $C_{2b}$ to $V_2$ and conductor $C_{3b}$ to the common. Alternatively, conductor $C_{2b}$ can be connected directly to the common and conductor $C_{3b}$ to $V_2$. Resistive element 102 has a top edge 104, a bottom edge 106, a left edge 108, a right edge 110, and a top surface 112. Conductor $C_{1b}$ has a top edge 114, a bottom edge 116, a right edge 118, and a flat bottom surface (not shown). Conductor $C_{3b}$ has a top edge 122, a bottom edge 124, a right edge 126, and a flat bottom surface 128. Conductors $C_{1b}$ and $C_{3b}$ have a width of a and b, respectively. Conductors $C_{1b}$ and $C_{3b}$ are attached to top surface 112 of resistive element 102. Right edge 118 of conductor $C_{1b}$ and right edge 126 of conductor $C_{3b}$ slightly overlap left edge 108 of resistive element 102. Top edge 114 of conductor $C_{1b}$ and top edge 104 are aligned as are bottom edge 106 and bottom edge 124 of conductor $C_{3b}$, respectively. Bottom edge 116 of conductor $C_{1b}$ and top edge 122 of conductor $C_{3b}$ are spaced from each other forming a gap therebetween.

Conductor $C_{2b}$ has a top edge 130 aligned with top edge 104, a bottom edge 132 aligned with bottom edge 106 of resistive element 102 and a left edge 134 slightly overlaps right edge 110 of resistive element 102. The ratio of the widths of the first and second conductors determines the relative size of the smallest intermediate size drops. The second embodiment also operates as a tri-modal ejector as described above with respect to the first embodiment.

Figure 3B:
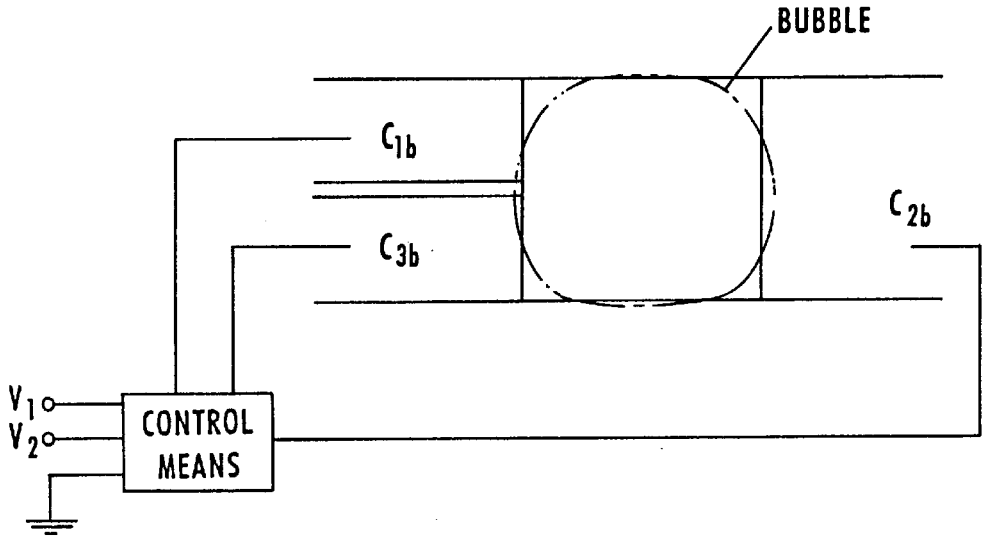
FIG. 3B is a top plan view of the printhead heater structure of FIGS. 3 and 3A showing bubble formation over a uniform electric field distribution.
Figure 3C:
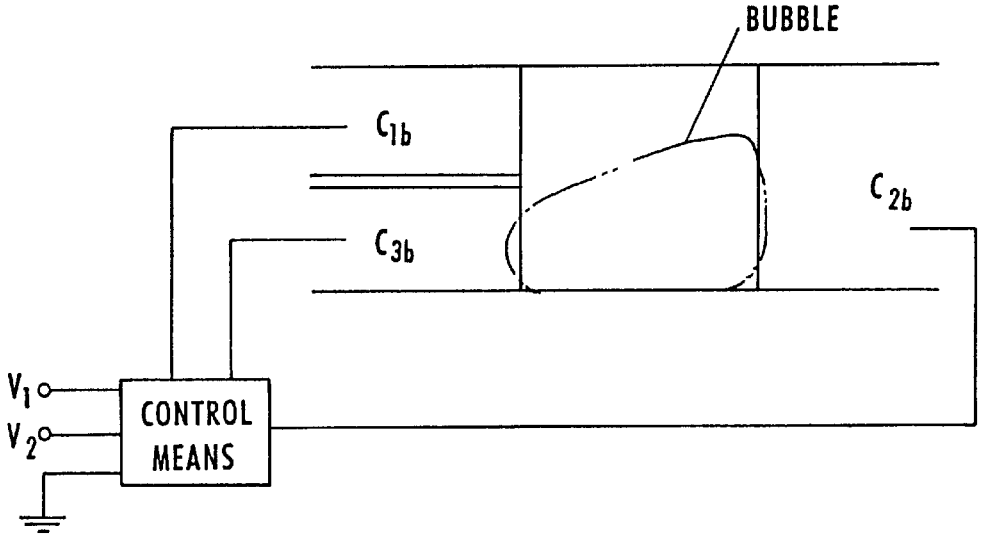
FIG. 3C is a top plan view of the heater structure of FIGS. 3 and 3B showing bubble formation over a non-uniform electric field.

Refer now to FIGS. 3B and 3C which depict an additional structure for varying drop mass. The control means is connected to a variable voltage source $V_1$, a constant voltage source $V_2$ and to a common.

When $V_1$ is at ground potential as depicted in FIG. 3B, the electric field in the heater is uniformly distributed allowing the entire heater surface area to participate in the nucleation/bubble growth process such that a uniform bubble size is formed thereby ejecting a uniform droplet mass.

As $V_1$ is increased, the electric field in the vicinity of $C_{1b}$ is reduced as depicted in FIG. 3C. This will directly effect power dissipation in this region and the resultant bubble size. As $V_1$ is increased relative to $V_2$ the bubble size will decrease, although the bubble so formed will be non-uniform in shape as shown in FIG. 3C.

Figure 4:
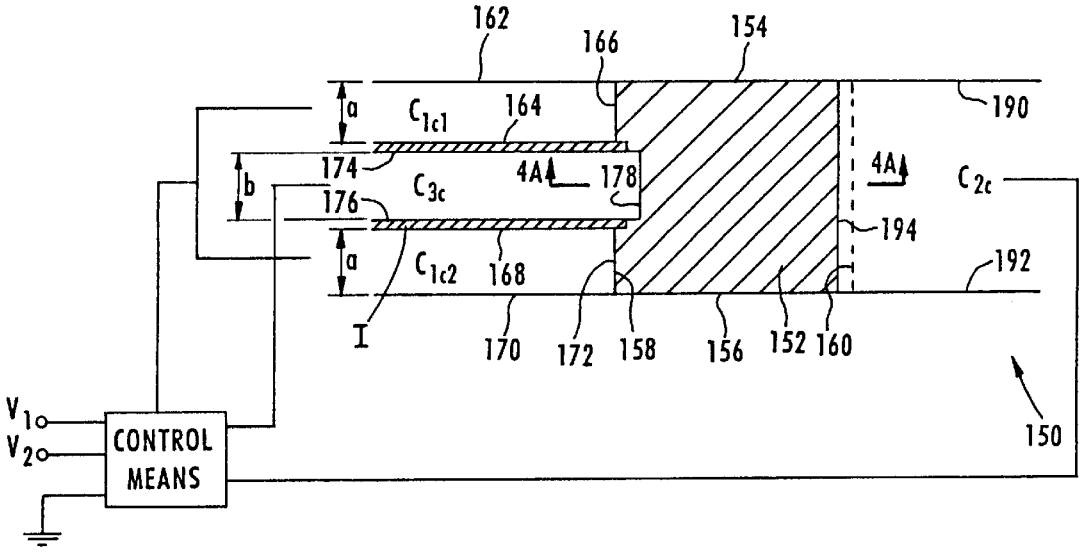
FIG. 4 is a top plan view of a third embodiment of the printhead heater structure of the present invention.
Figure 4A:
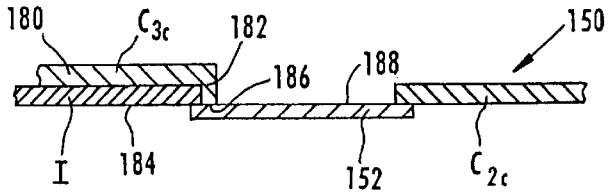
FIG. 4A is a side sectional elevational view taken along line 4A—4A of FIG. 4 depicting only the resistive element and associated conductors.

Refer now to FIGS. 4 and 4A where a printhead heater structure according to a third embodiment of the present invention is illustrated. A firing element 150 includes a flat rectangular resistive element 152, a first conductor (divided into two symmetrical active sections $C_{1c1}$ and $C_{1c2}$, respectively), a second conductor $C_{2c}$, a third conductor $C_{3c}$ and an insulator I. Resistive element 152 has a top edge 154, a bottom edge 156, a left edge 158, and a right edge 160. First conductor $C_{1c1}$ has a top edge 162 aligned with top edge 154 of the resistive element, a bottom edge 164, and a right edge 166 in electrical contact with a portion of left edge 158 of resistive element 152. Another portion of the first conductor $C_{1c2}$ has a top edge 168, a bottom edge 170 aligned with bottom edge 156 of resistive element 152, and a right edge 172. A patterned insulator layer I electrically isolates conductors $C_{1c}$ and $C_{3c}$. Insulator I has a top edge 174 contacting bottom edge 164 of conductor $C_{1c1}$, a bottom edge 176 in contact with top edge 168 of conductor $C_{1c2}$, and a right edge 178 which extends inwardly beyond left edge 158 of resistive element 152.

The third conductor $C_{3c}$ has an elongate portion 180 and a downwardly extending portion 182. A lower surface 184 of conductor $C_{3c}$ is in contact with insulator I. A lower surface 186 of downwardly extending portion 182 is in contact with an upper surface 188 of resistive element 152. The second conductor $C_{2c}$ has a top edge 190 aligned with top edge 154 of resistive element 152, a bottom edge 192 aligned with bottom edge 156 of resistive element 152, and a left edge 194 slightly overlapping right edge 160 of resistive element 152.

A control means is connected to a first constant voltage source $V_1$ and to a second constant voltage source $V_2$, and to a common. Conductors $C_{1c1}$, $C_{1c2}$ and conductor $C_{2c}$ are fabricated in one mask step. Conductor $C_{3c}$ is fabricated in a later mask step. This third embodiment can be operated as a tri-modal drop ejector by activating the conductors in pairs. To achieve a small drop conductor $C_{3c}$ is activated. To achieve a medium drop conductors $C_{1c1}$, and $C_{1c2}$ are activated. To achieve a large drop all the conductors are activated. The control means acts as a switch for coupling conductors $C_{1c1}$ and $C_{1c2}$ to $V_1$, conductor $C_{2c}$ to $V_2$ and conductor $C_{2c}$ to the common. Alternatively, conductor $C_{2c}$ can be connected directly to the common.

Alternatively, conductors $C_{1c1}$ and $C_{1c2}$ can be formed from a single conductor underlying insulator 1.

In this third embodiment, drop mass can also be varied in the same manner as described above with respect to FIGS. 3B and 3C. Conductors $C_{1c1}$ and $C_{1c2}$ can be connected to a variable voltage source $V_1$ through the control means. Conductor $C_{2c}$ can be connected to a common, or ground. Conductor $C_{3c}$ can be connected to a constant voltage source $V_2$.

Figures 5, 5A:
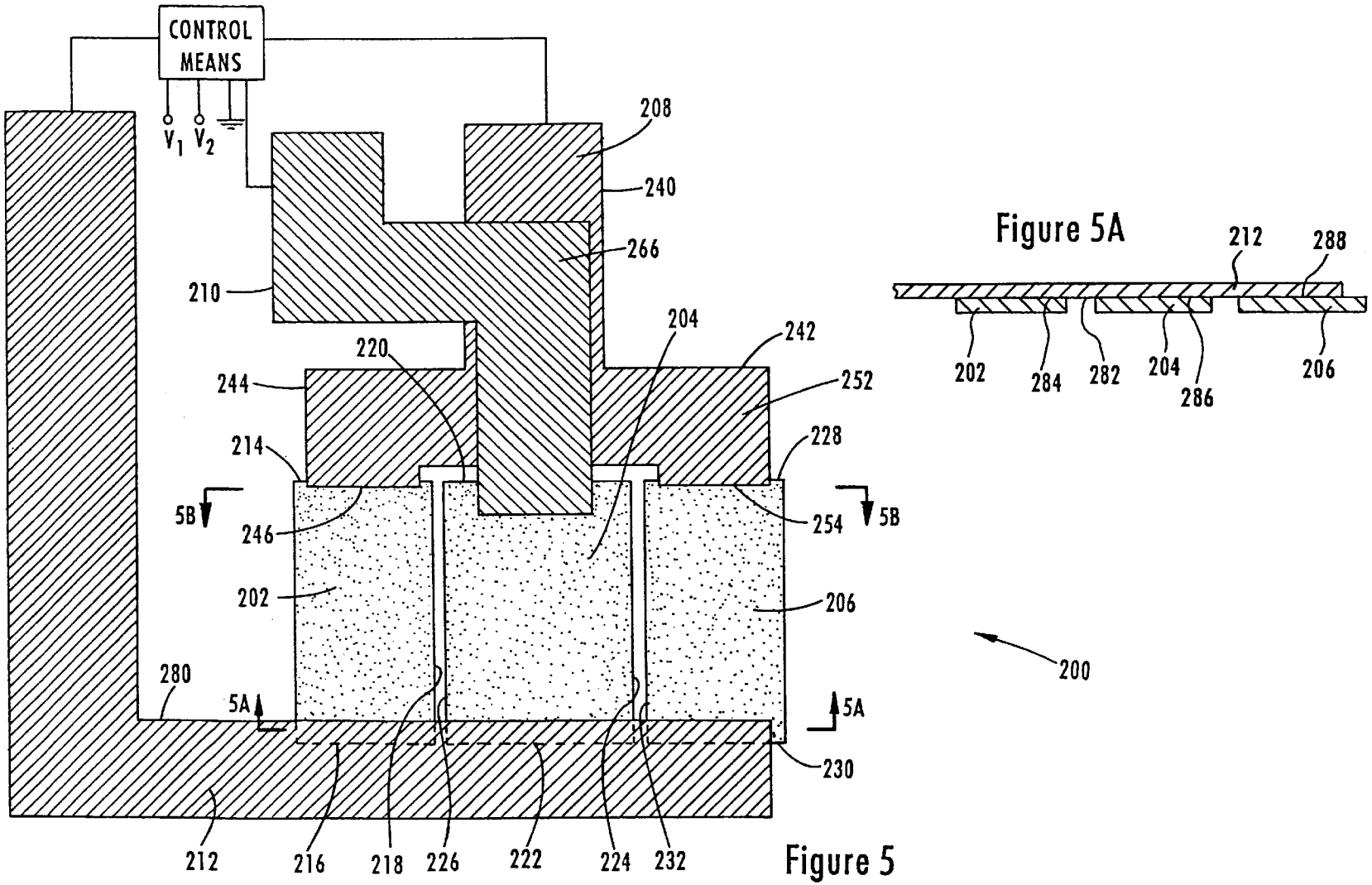
FIG. 5 is a top plan view of a fourth embodiment of the printhead heater structure of the present invention.
FIG. 5A shows a side sectional elevational view taken along line 5A—5A of FIG. 5.
Figure 5B:
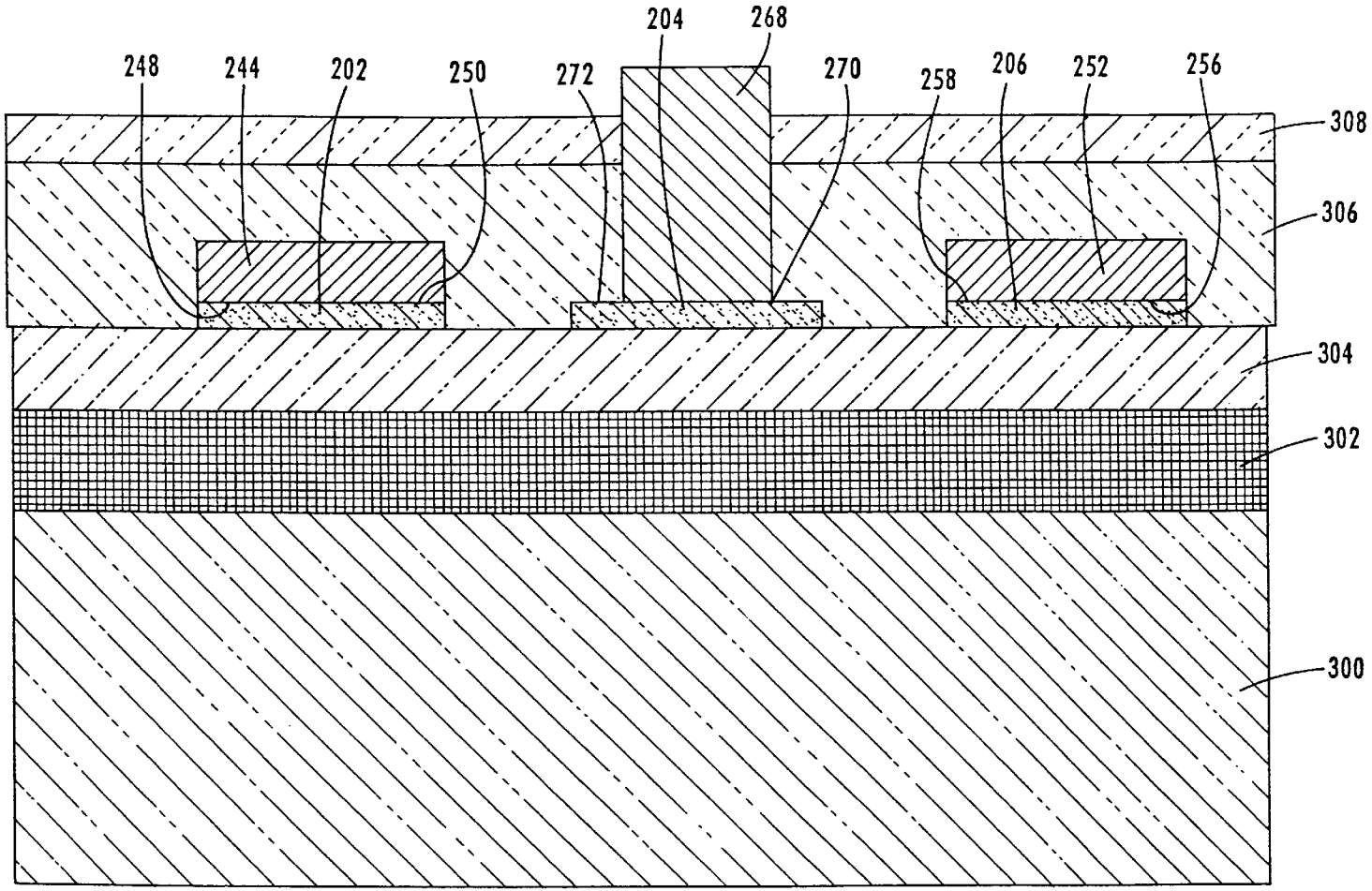
FIG. 5B shows a side elevational view taken along line 5B—5B of FIG. 5.

Refer now to FIGS. 5, 5A and 5B where a printhead heater structure according to a fourth embodiment of the present invention is illustrated. A firing element 200 includes a first flat rectangular resistive element 202, a flat rectangular second resistive element 204, a third flat rectangular resistive element 206, and a first conductor 208, a second conductor 210, and a third conductor 212.

First resistive element 202 has a top edge 214, a bottom edge 216, and a right edge 218. Second resistive element 204 has a top edge 220, a bottom edge 222, a right edge 224, and a left edge 226. Third resistive element 206 has a top edge 228, a bottom edge 230, and a left edge 232. First resistive element 202 and third resistive element 206 are symmetrical and are symmetrically disposed about second resistive element 204.

First resistive element 202 has right edge 218 spaced from left edge 226 of second resistive element 204. Third resistive element 206 has left edge 232 spaced from right edge 224 of second resistive element 204. Top edge 214, top edge 220, and top edge 228 are aligned. Bottom edge 216, bottom edge 222, and bottom edge 230 are aligned.

Resistive elements 202, 204, 206 are rectangular in shape and flat. Second resistive element 204, as depicted in FIG. 5 has a larger cross-sectional area than either resistive elements 202 or 206. As depicted in FIG. 5, resistive elements 202 and 206 have the same cross-sectional area.

First conductor 208 has an elongated portion 240 which terminates in a transversely disposed transverse portion 242. A first extending portion 244 extends from transverse portion 242 and terminates in an edge 246 which slightly overlaps top edge 214 such that a bottom surface 248 lies on and is in electrical contact with top surface 250 of first resistive element 202. Similarly, a right extending portion 252 extends beyond top edge 228 terminating in edge 254 such that a bottom surface 256 of right extending portion 252 overlies a top surface 258 of the third resistive element 206 and is in electrical contact therewith.

Second conductor 210 has an elongated portion 266 spaced from elongated portion 240 of first conductor 208. A downwardly extending portion 268 extends downwardly from elongated portion 266 and has a surface 270 in contact with an upper surface 272 of second resistive element 204.

First conductor 208, second conductor 210, and third conductor 212 are connected to a control means. The control means is connected to a first constant voltage source $V_1$, a second constant voltage source $V_2$ and to a common. The control means acts as a switch for coupling first conductor 208 to $V_1$, second conductor 210 to $V_2$, and third conductor 212 to the common. Alternatively, third conductor 212 can be connected directly to the common.

Third conductor 212 has an upper edge 280 which is parallel to bottom edges 216, 222 and 230. A surface 282 of conductor 212 depicted in FIG. 5A is disposed above surfaces 284, 286 and 288 of first resistive element 202, second resistive element 204 and third resistive element 206, respectively, such that third conductor 212 is in electrical contact with resistive elements 202, 204, 206.

Refer now to FIG. 5B where a side elevational view is illustrated. Although not essential to the invention, for the sake of completeness, the thin-film layers of firing element 200 are shown. The bottom layer 300 is silicon. Covering layer 300 is a second layer 302 formed of silicon dioxide. A third layer formed on the second layer 304 is a layer of boron phosphorous silicon glass. The first, second, and third resistive elements 202, 204, 206 are formed on the third layer. First conductor 208 and second conductor 210 are formed with portions disposed above resistive elements 202, 204, 206. Overlying all but downwardly extending portion 268 is a layer of silicon nitride 306. Overlying the entire silicon nitride layer is a layer of silicon carbide 308.

This fourth embodiment is operable as a tri-modal drop ejector. To achieve a small drop, conductor 210 is activated. To achieve a larger drop, conductor 208 is activated. The ratio of the drop size between the two drops is determined (assuming that the voltage of the first and second constant voltage source are equal) by the relative cross-sectional areas of elements 202, 206 and 204. The largest drop is achieved by activating all the conductors.

Figure 6A:
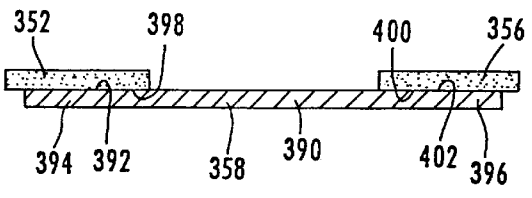
FIG. 6A is a side elevational view taken along line 6A—6A of FIG. 6.
Figure 6:
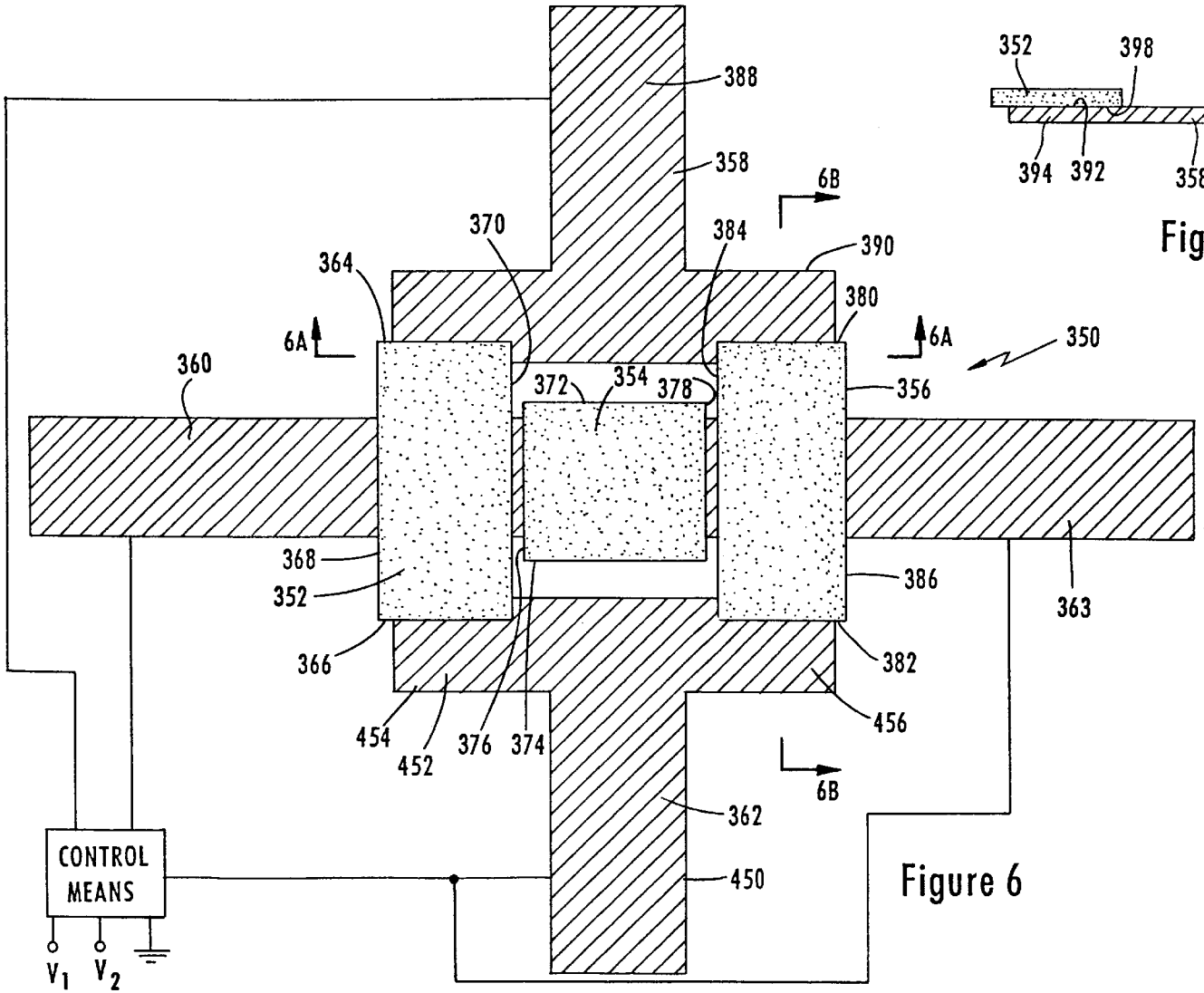
FIG. 6 shows a top plan view of a fifth embodiment of the printhead heater structure of the present invention.
Figure 6B:
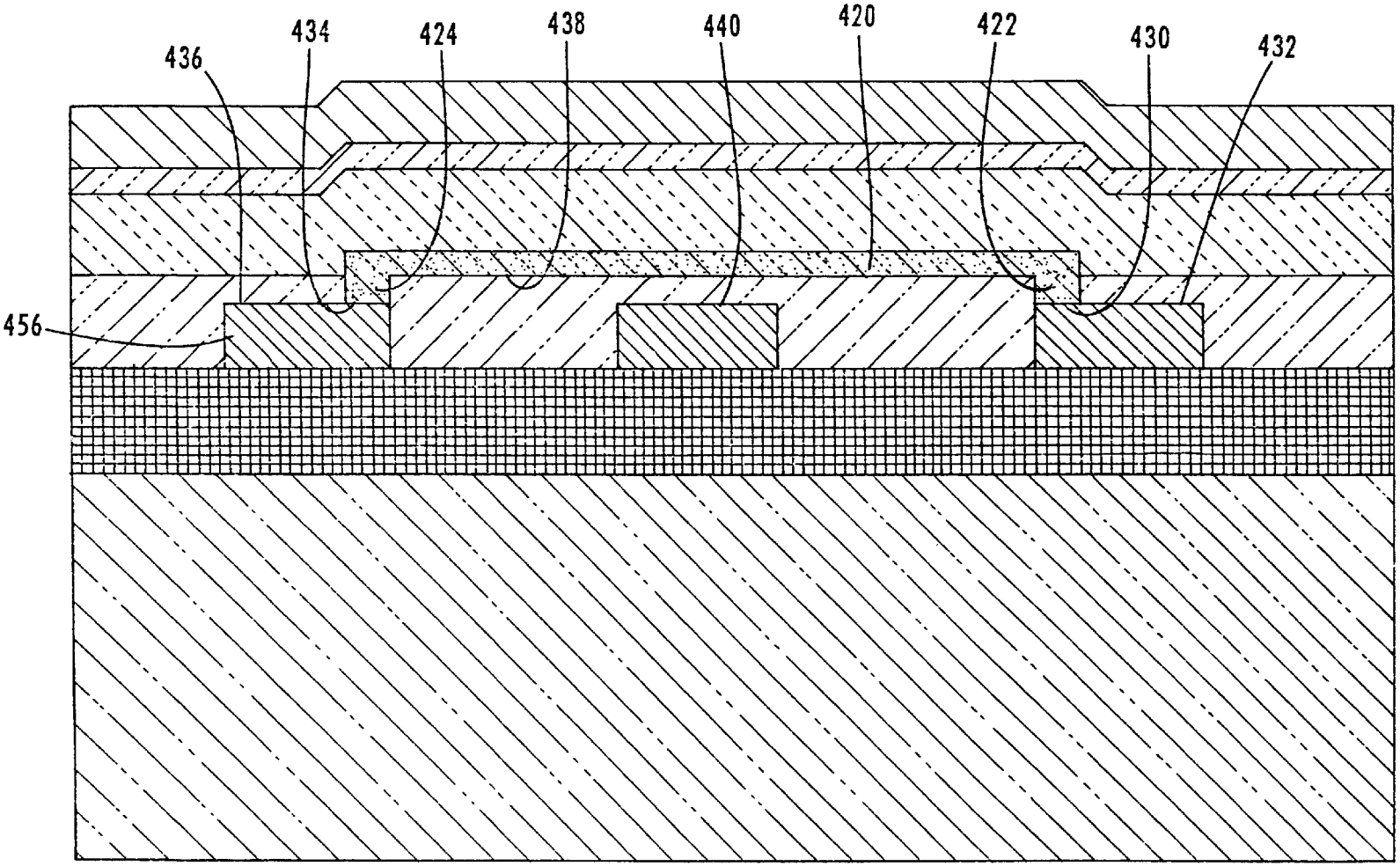
FIG. 6B is a side elevational view taken along line 6B—6B of FIG. 6.

Refer now to FIGS. 6, 6A and 6B where a printhead heater stricture according to a fifth embodiment of the present invention is illustrated. Firing element 350 includes a first flat rectangular resistive element 352, a second flat rectangular resistive element 354, a third flat rectangular resistive element 356, a first conductor 358, a second conductor 360, a third conductor 362, and a fourth conductor 363.

First resistive element 352 has a top edge 364, a bottom edge 366, a left edge 368, and a right edge 370. Second resistive element 354 has a top edge 372, a bottom edge 374, a left edge 376, and a right edge 378. Third resistive element 356 has a top edge 380 aligned with top edge 364, a bottom edge 382 aligned with bottom edge 366, a left edge 384 having the same length as right edge 370, and a right edge 386. The length of right edge 378 is less than the length of right edge 370. First resistive element 352 and third resistive element 356 are disposed symmetrically about second resistive element 354 such that right edge 370 of first resistive element 352 is adjacent to and spaced from left edge 376 of second resistive element 354. Similarly, left edge 384 of third resistive element 356 is adjacent to and spaced from right edge 378 of second resistive element 354.

First conductor 358 has an elongate portion 388 terminating in a transverse portion 390. As depicted in FIG. 6A, transverse portion 390 has a left portion 394 and a right portion 396. Left portion 394 has an upper surface 392 disposed beneath a lower surface 398 of first resistive element 352 and a right portion 396 has an upper surface 402 disposed below a lower surface 400 of third resistive element 356.

Refer now to FIG. 6B where a side elevational view is illustrated. Although section line 6B—6B is drawn through third resistive element 356 it should be understood that because first resistive element 352 is symmetrical with third resistive element 356 that the following description applies to both elements. Third resistive element 356 has a horizontal portion 420 and extending from one end thereof is a first downwardly extending portion 422 and from the opposite end thereof a second downwardly extending portion 424. Downwardly extending portion 422 has a lower surface 430 in electrical contact with an upper surface 432 of first conductor 358. Similarly, a lower surface 434 of downwardly extending portion 424 is in electrical contact with an upper surface 436 of third conductor 356.

A lower surface 438 of horizontal portion 420 is vertically spaced from an upper surface 440 of third conductor 356. Second conductor 354 has its lower surface (not illustrated) in direct contact with upper surface 440 of second conductor 360.

Referring back to FIG. 6, third conductor 362 has an elongated portion and a transverse portion 452 divided into a left side 454 and a right side 456. Conductors 358, 360, 362 and 363 are connected to a control means. The control means acts as a switch for coupling conductor 358 to $V_1$, conductor 360 to $V_2$ and conductors 362 and 363 to a common. Alternatively, conductors 362 and 363 can be connected directly to the common. This fifth embodiment is operable as a tri-modal ejection by activating the conductors in pairs. To achieve a small drop, conductor 360 is activated. To achieve a larger drop, conductor 358 is activated. The ratio of the drop size between the two drops is determined (assuming that the voltage of the first and second constant voltage sources are equal) by the relative cross-sectional areas. The largest drop is achieved by activating all the conductors.

It should now be apparent from the foregoing detailed description that an ink jet printhead heater structure has been described that can modulate the size of ejected ink drops without complex circuitry and where the interrelationship of factors that determine drop size is kept relatively simple and straightforward.

It will be readily seen by one of ordinary skill in the art that the present invention fulfills all of the objects set forth above. After reading the foregoing specification, one of ordinary skill will be able to affect various changes, substitutions of equivalence and various other aspects of the invention as broadly disclosed herein. It is therefore intended that the protection granted hereon be limited only by the definition contained in the appended claims and equivalents thereof.

We claim:

1. An ink jet printhead chip for use in an ink jet printhead having a cavity in communication with a supply of ink and a nozzle, said chip comprising:

a plurality of at least three conductors; and a unitary actuator corresponding to said nozzle and coupled to said plurality of at least three conductors, said unitary actuator having a first active section and a second active section said first active section and said second active section being defined by a location of attachment of each of said plurality of at least three conductors to said unitary actuator;

wherein said first active section and said second active section are defined to be located at a substantially equal distance from the nozzle, wherein said plurality of at least three conductors comprises:

a first conductor coupled to a first region of said unitary actuator for defining said first active section;

a second conductor coupled to a second region of said unitary actuator for defining said second active section; and a third conductor coupled to a third region of said unitary actuator to provide a common connection for defining said first active section and said second active section, wherein said unitary actuator has a first edge and a second edge, said first conductor connected to said first edge along a major portion thereof, said third conductor connected to said second edge along a major portion thereof, and further comprising an electrical insulation overlaying a portion of said first conductor and a portion of said actuator, wherein said third conductor is connected to an upper surface of said actuator.

2. The ink jet printhead of claim 1, wherein said first conductor is connected to said first edge at two separated regions of said unitary actuator.

* * * * *